US005611191A

United States Patent [19]

Bailey et al.

[11] Patent Number: 5,611,191

[45] Date of Patent: Mar. 18, 1997

[54] CIGARETTE PACKING MACHINE

[75] Inventors: Thomas W. Bailey; Michael J. Cahill, both of Coventry; Stanley V. Starkey, London; Robert H. Taylor, High Wycombe, all of England

[73] Assignee: Molins PLC, Milton Keynes, England

[21] Appl. No.: 387,559

[22] Filed: Feb. 13, 1995

[30] Foreign Application Priority Data

Jun. 25, 1994 [GB] United Kingdom ..... 9412801

[51] Int. Cl.[6] ..... B65B 19/04

[52] U.S. Cl. ..... 53/148; 53/151; 53/252; 53/535; 198/418.1; 198/430; 131/282; 131/283

[58] Field of Search ..... 198/429, 430, 198/418.1, 418.2, 418.3, 419.3; 53/148, 149, 150, 151, 251, 252, 535; 131/282, 283

[56] References Cited

U.S. PATENT DOCUMENTS

| | | | |
|---|---|---|---|
| 3,579,952 | 5/1971 | Davies et al. . | |
| 4,167,091 | 9/1979 | Ruppert et al. | 53/151 X |

FOREIGN PATENT DOCUMENTS

| | | |
|---|---|---|
| 379277 | 8/1932 | United Kingdom . |
| 751175 | 6/1956 | United Kingdom . |
| 881068 | 11/1961 | United Kingdom . |
| 1106363 | 3/1968 | United Kingdom . |
| 1570605 | 7/1980 | United Kingdom . |

*Primary Examiner*—Daniel Moon

*Attorney, Agent, or Firm*—Antonelli, Terry, Stout & Kraus, LLP

[57] ABSTRACT

A cigarette packing machine comprises a series of individual cigarette hoppers (18) carried by an endless band (16), the hoppers receiving cigarettes from an input conveyor (15) in a receiving region and supplying groups of cigarettes to a pocketed bundle conveyor (22) in a delivery region. Each hopper (18) may be vertically movable, with its position controlled so that it occupies an upper position in the receiving region and a lower position in the delivery region. The hoppers may be vibrated during movement by the endless band, so as to promote downward movement of the cigarettes. Preferably each hopper has an associated transfer plunger (46) which is extended to deliver cigarettes in the delivery region, the hopper being lifted when the plunger is in its extended position and lowered when the plunger is in its retracted position.

14 Claims, 7 Drawing Sheets

CIGARETTE PACKING MACHINE

Figure 1:
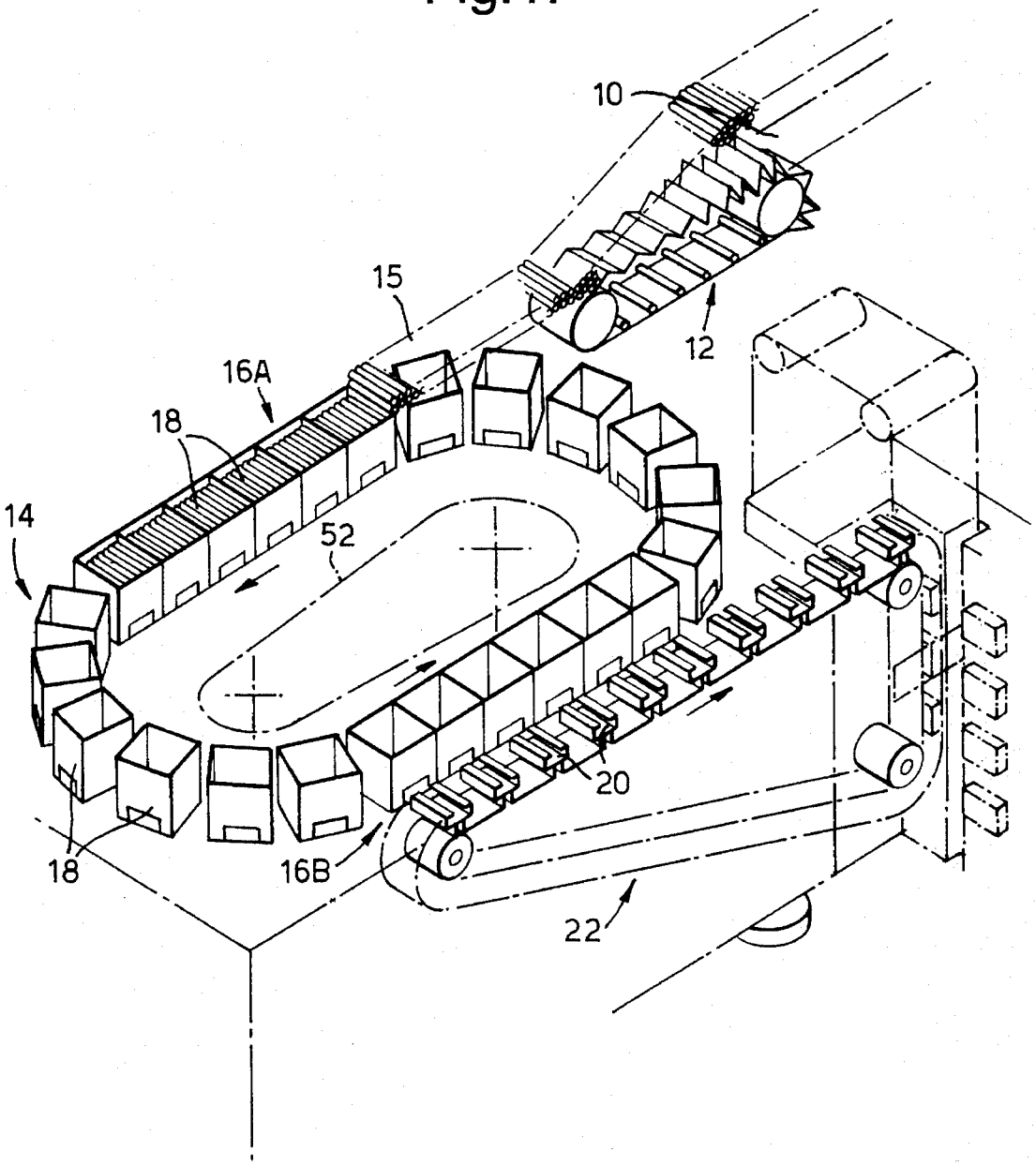

This invention relates to cigarette packing machines, and in particular to a novel hopper arrangement capable of use in continuous motion packing machines.

According to one aspect of the invention a cigarette packing machine comprises a series of individual cigarette hoppers movable on a first endless path, means for delivering cigarettes to successive hoppers as they pass a delivery position in a first part of said path, means for delivering at least one row of cigarettes from successive hoppers along a second part of said first path, second conveyor means conveying a series of receiving members along a second endless path, said second path having a portion which is parallel with said second part of said first path along which said at least one row of cigarettes is transferred from successive hoppers to successive receiving members. After delivery along said second part of the path the rows may be conveyed by a group conveyor, e.g. a pocketed bundle conveyor.

Preferably the hoppers are individual units carried on a generally horizontal path; in one preferred arrangement the hoppers are conveyed by an endless band or the like. Preferably the delivery position is arranged on a straight part of said path, as preferably is said second part of said path.

Preferably each row of cigarettes is delivered from the bottom of the hoppers along said second part of said path. In such case, in a preferred arrangement wherein said endless path is generally horizontal the hoppers are movable to a limited extent in a generally vertical direction, so that they are at a higher level on said first part of said path and on a lower level along said second part of said path. Thus, subsequent to delivery of a row from the bottom of the hopper along the second part of said path the hopper may be progressively raised to allow cigarettes remaining in the hopper to descend and correspondingly allow room for further cigarettes to be delivered to the hopper on the first part of said path. In one preferred arrangement the row delivering means includes a pusher member for delivering the cigarettes in a direction parallel to their lengths, the hoppers being raised above the pusher member to allow the cigarettes to descend after delivery of a row but before the pusher is retracted. The hoppers may receive cigarettes from the delivering means while in their upper positions and may be subsequently lowered again prior to the pusher member being advanced along the second part of the path. Preferably each individual hopper carries its own cam-operated pusher member.

Vertical movement of the individual hoppers while travelling on the endless path may be also be achieved by cams. Superimposed on any general vertical movement may be a shorter term or vibratory movement intended to assist downward movement of the cigarettes in the hoppers.

According to another aspect of the invention a cigarette packing machine comprises a series of individual cigarette hoppers movable on an endless path, means for delivering cigarettes to successive hoppers as they pass a delivery position in a first part of said path, and means for delivering at least one row of cigarettes from successive hoppers along a second part of said path, including means for imposing vibrational reciprocal motion on the hoppers as they circulate on said path, so as to assist downward movement of cigarettes in the hoppers.

Each individual hopper may carry cam-operated driven agitators (e.g. rollers given a back and forth movement) also for assisting downward movement of cigarettes in the hoppers.

According to a further aspect of the invention a cigarette packing machine includes at least one hopper, means for supplying cigarettes to the hopper, means for delivering a row of cigarettes from the bottom of the hopper, said delivering means including a plunger movable from a retracted position to an extended position in order to axially remove a row from the bottom of the hopper, and means for cyclically lifting and lowering the hopper relative to said plunger, said hopper being lifted when said plunger is in said extended position and lowered when said plunger is in said retracted position.

Figure 2:
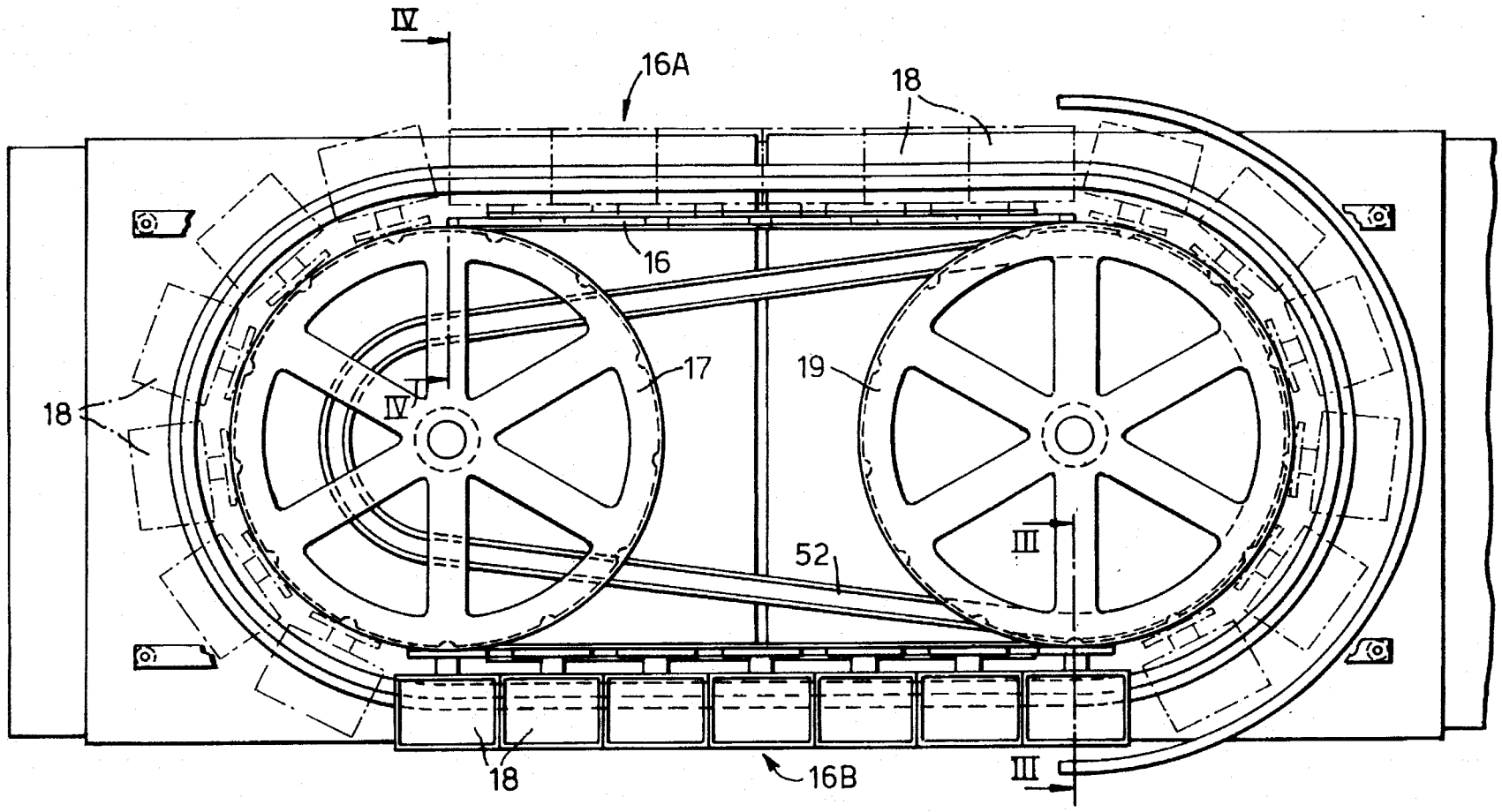
Figure 3:
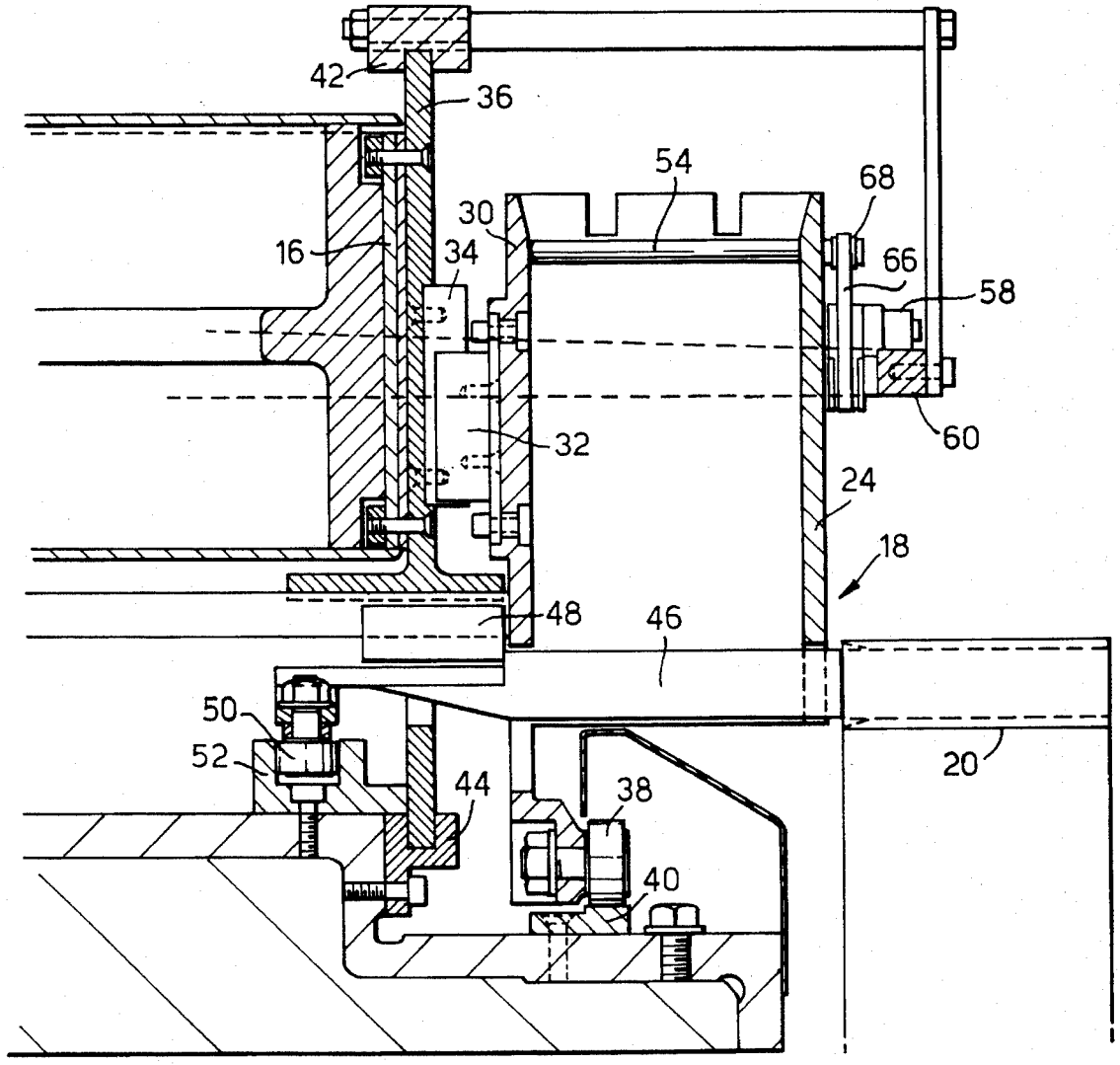
Figure 4:
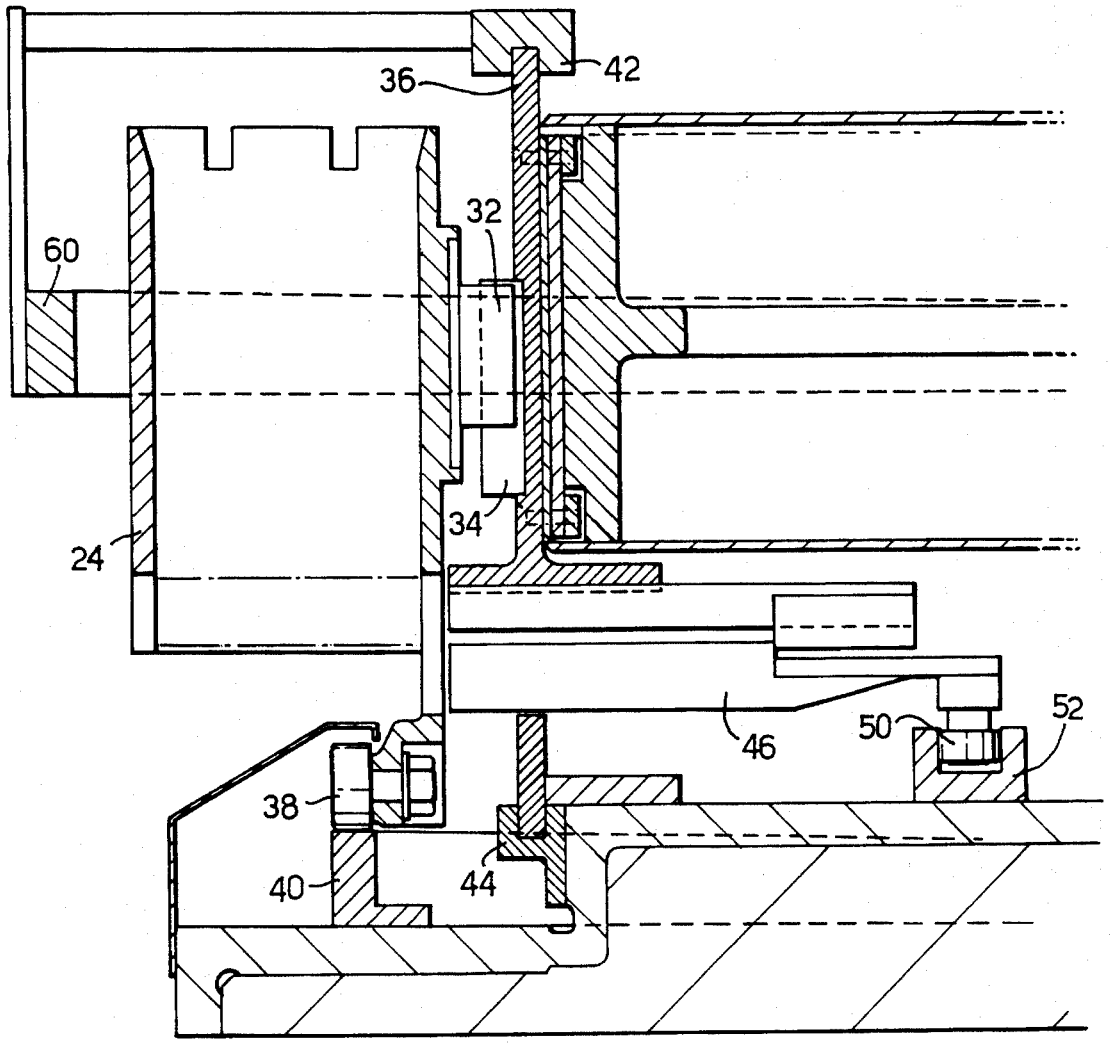
Figure 5:
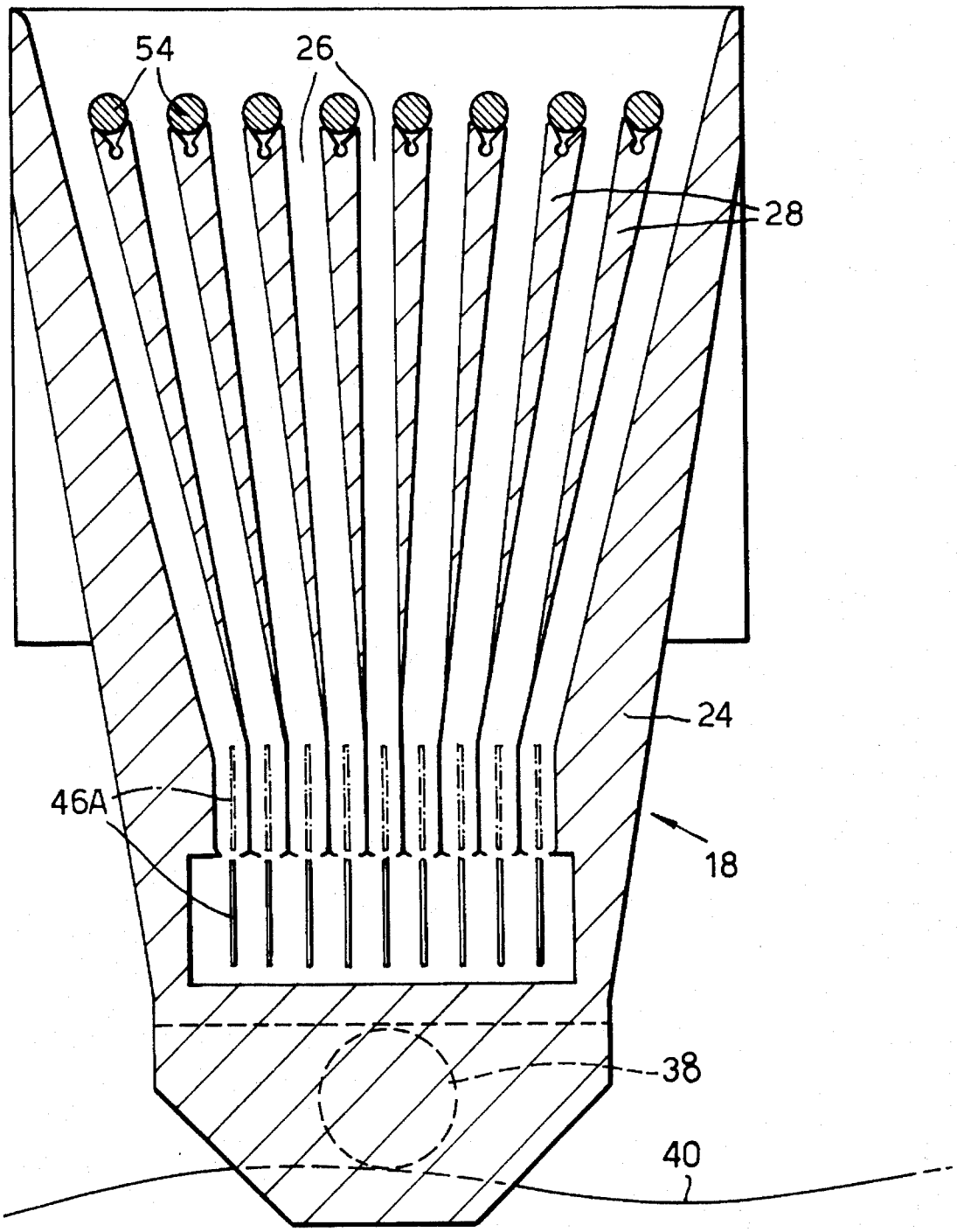
Figure 6:
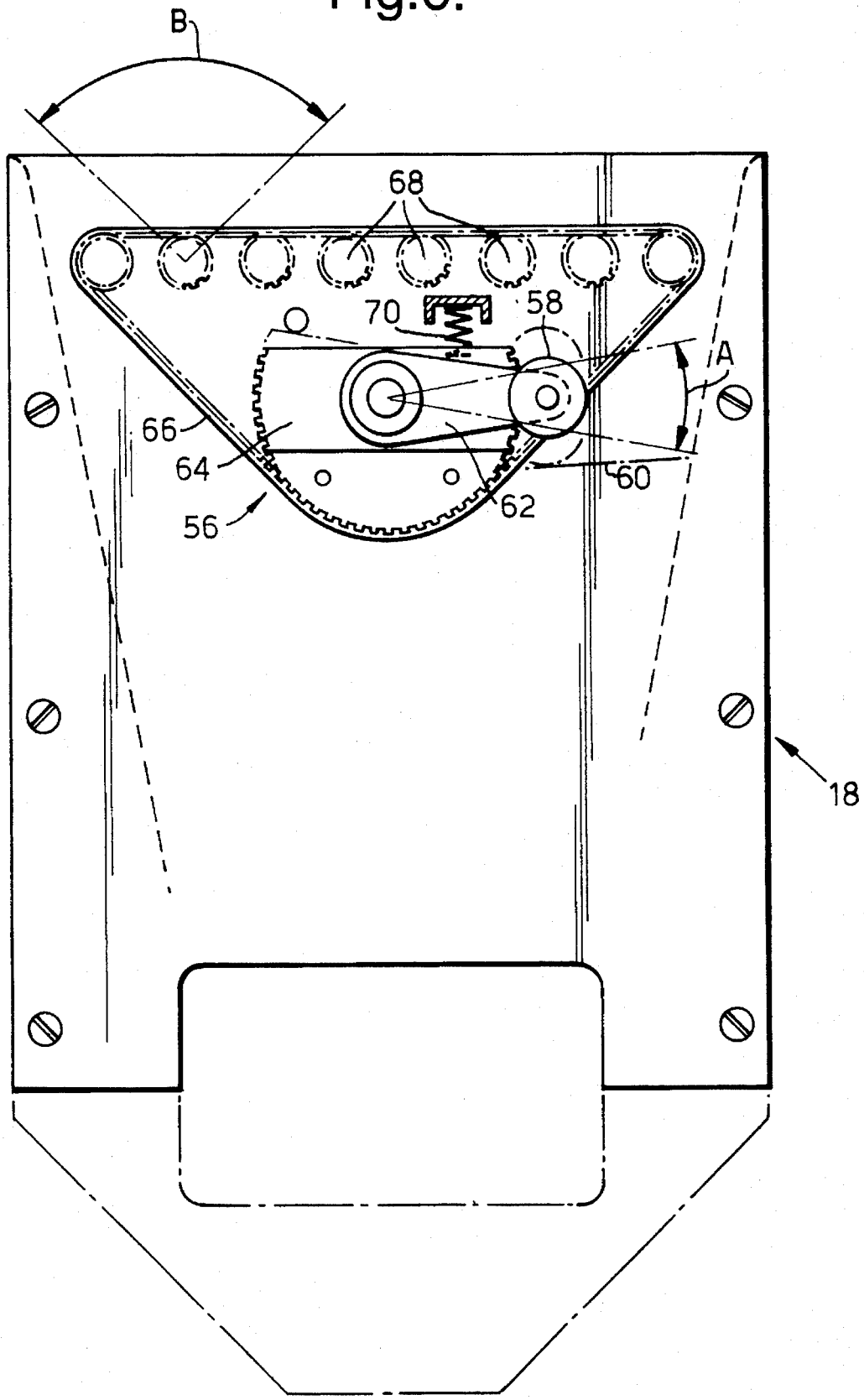
Figure 7:
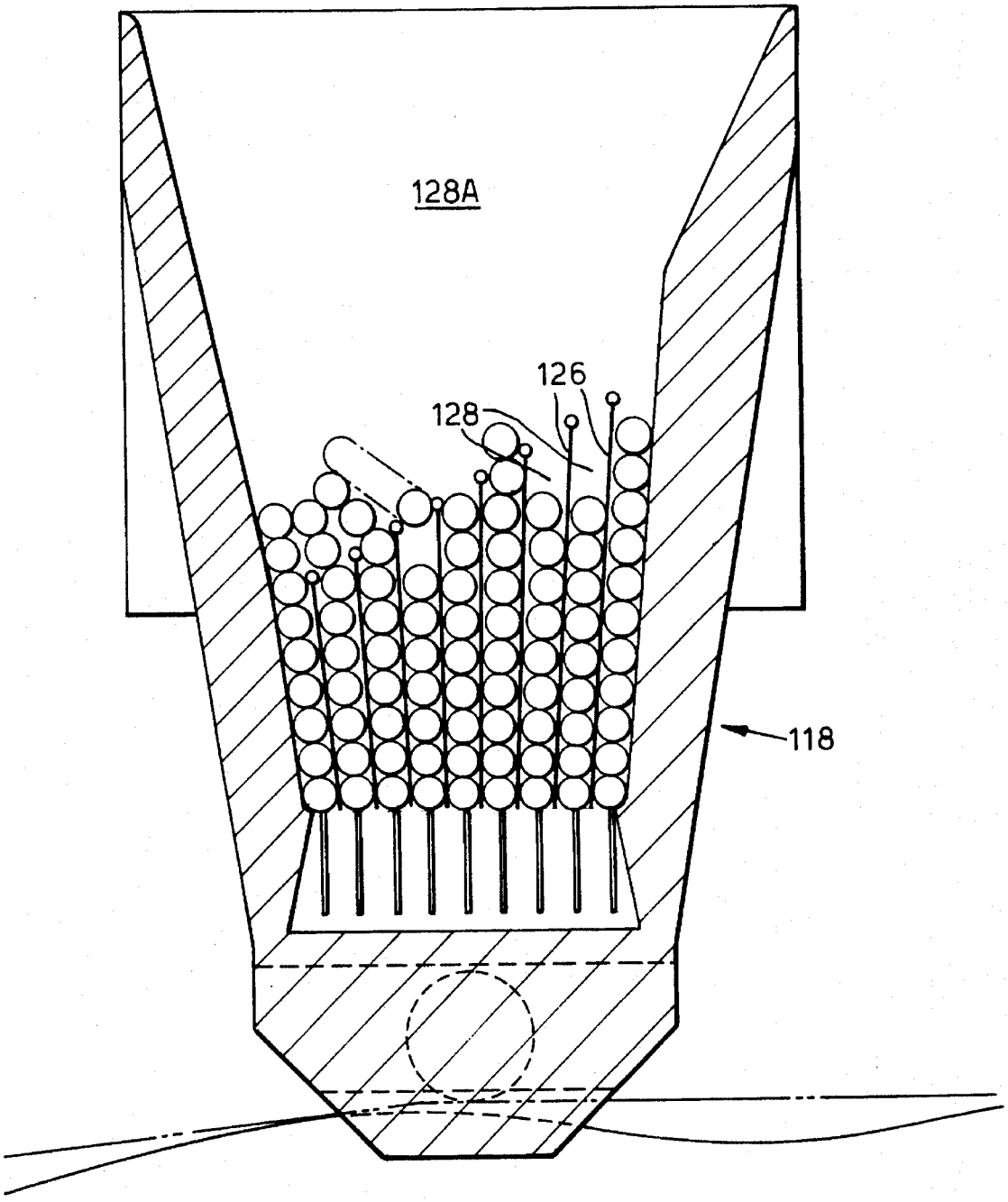

The invention will be further described, by way of example only, with reference to the accompanying diagrammatic drawings, in which:

FIG. 1 is a perspective view of part of a cigarette packing machine incorporating a rotary hopper device, FIG. 2 is a plan view of the rotary hopper device shown in FIG. 1, FIG. 3 is a sectional view on the line III—III in FIG. 2, FIG. 4 is a sectional view on the line IV—IV in FIG. 2, FIG. 5 is an enlarged pad-sectional view of an individual hopper of the device of FIG. 2, FIG. 6 is a view of a hopper similar to that of FIG. 5, and FIG. 7 is a view, similar to that of FIG. 5, of a modified individual hopper.

FIG. 1 shows part of a continuous cigarette packing machine in which a multi-layer stream of cigarettes 10 delivered from a cigarette making machine is reduced in height by an input conveyor 12 and transferred to a delivery conveyor 15 so that a stream which is only one or two cigarettes in height is delivered to a rotary hopper device 14 comprising an endless conveyor 16 (FIG. 2) carrying a series of individual hoppers 18. The endless conveyor 16 comprises a belt passing around pulleys 17 and 19 rotatable about vertical axes. The nature of the input conveyor 12 forms no part of this invention: one known method for reducing the height of a multi-layer stream of cigarettes is disclosed in U.S. Pat. No. 3579952.

Referring also to FIG. 2, the hoppers 18 are carried by the conveyor 16 so that successive hoppers are abutting on the straight runs of the conveyor. The delivery conveyor 15 delivers a stream of cigarettes onto the open upper ends of the hoppers 18 along one straight run 16A of the conveyor 16. Substantially full hoppers 18 are conveyed around the conveyor 16 to the opposed straight run 16B, along which groups of cigarettes are progressively transferred from the bottom of each hopper to a pocket 20 of a bundle conveyor 22 which runs in parallel with the conveyor 16 in this region. The bundle conveyor 22 delivers the groups of cigarettes to a downstream part of the packing machine, which forms no part of this invention, in which the groups of cigarettes are wrapped and packaged.

Referring now also to FIGS. 3–5, each hopper 18 comprises a body 24 having a series of generally vertical channels 26 defined by vanes 28. Attached to the rear face 30 of each body 24 is a member 32 which is vertically slidable relative to a complementary member 34 attached to a back support 36 itself carried by the conveyor 16. The upper and lower ends of the back supports 36 are guided by and run in stationary channel members 42, 44. At its lower end the body 24 carries a cam roller 38 which is movable on a track 40 extending beneath the path of the conveyor 16. As may be seen by comparison of the position of the bodies 24 in FIGS. 3 and 4, engagement of the roller 38 with the track 40 controls the vertical position of the bodies.

At a level below that of the conveyor 16 the support 36 carries a pusher member 46 which is attached to a member 48 which is horizontally slidable relative to the support 36. The pusher 46 comprises fingers 46A which are capable of interdigitating with the lower ends of the vanes 28, as shown in FIG. 5. The pusher 46 and member 48 are connected to a cam roller 50 movable in a stationary track 52 so as to cause the pusher member 46 to move between an extended position, as shown in FIG. 3, and a retracted position, as shown in FIG. 4.

In operation, a group of cigarettes consisting of three rows is progressively ejected from the base of each hopper body 24 by advancement of the pusher member 46 as the body moves along the path 16B of conveyor 16 adjacent the pocket conveyor 22. On this part of the conveyor 16 the body 24 is in its lowermost position, as shown in FIG. 3, and the fingers 46A of the pusher member 46 interdigitate between the vanes 26, as indicated by the dotted lines in FIG. 5. During movement of the hopper 18 around the pulley 19 cam track 40 progressively lifts the body 24 while the pusher fingers 46A remain in place. The cigarettes in the channels 26 thus descends and by the time the hopper 18 reaches a position underneath the delivery conveyor 15 it is in its uppermost position (i.e. the position shown in full lines in FIG. 5) with the fingers completely below the channels. (With respect to the diagrammatic representation of the relative positions of the fingers 46A in FIG. 5 it will be appreciated that it is the hopper 18 which moves vertically and not the fingers.)

The conveyor 15 delivers cigarettes to the space above the channels 26 so that each hopper 18 is replenished as it passes the conveyor. During movement of the hopper 18 along the straight path 16A of conveyor 16 from the pulley 19 to the pulley 17 the pusher member 46 is retracted. The hopper 18 is lowered again while moving around the pulley 17 so as to be in its lowermost position when advancement of the pusher member 46 again starts on the straight path 16B of the conveyor 16 from pulley 17 to pulley 19.

In order to encourage the cigarettes to descend in the channels 26 the cam track 40 may include slight undulations (as shown in FIG. 5) in the region of the path of conveyor 16 around the pulley 19, and possibly also along the run from pulley 19 to pulley 17. The up and down movement thereby imparted to the hopper bodies 24 tends to assist the descent of the cigarettes.

Each hopper 18 includes agitator rollers 54 arranged at the top of the vanes 28. These are rotated back and forth to encourage movement of cigarettes into the channels 26 from the region above. Each hopper 18 includes a drive mechanism 56 for the agitator rollers, this mechanism including a cam roller 58 which engages a cam track 60 extending around the region of the path of conveyor 16 passing around pulley 19. As best seen in FIG. 6 the cam roller 58 is attached by way of an arm 62 to a gear segment 64. A timing belt 66 passes around the segment 64 and also around pulleys 68 attached to the ends of the agitator rollers 54. A compression spring 70 operating on the segment 64 maintains the cam roller 58 in contact with the cam track 60 as the hoppers 18 move with the conveyor, the track having undulations which cause the follower 58 to pivot the segment 62 through an arc A as indicated in FIG. 6, this in turn causing the pulleys 68 and associated agitator rollers 54 to rotate back and forth through an arc B by virtue of motion transmitted by the belt 66.

FIG. 7 shows an alternative hopper 118 in which agitator rollers 54 (and their associated drive) are omitted. The hopper 118 includes a series of vanes 126 with simple rounded upper ends and of varying lengths defining an inclined transition between the channels 128 and the region 128A above them. The inclined upper line of the vanes 126 is believed to assist in promoting descent of cigarettes in the channels 128 and avoiding and/or realigning cigarettes which become misaligned.

We claim:

1. A cigarette packing machine comprising a series of individual hoppers, first conveyor means for conveying said hoppers on a first endless path, means for delivering cigarettes to successive hoppers as they pass a delivery position in a first part of said first path, said first part of said first path downstream of said delivery position being substantially straight and said delivering means upstream of said delivery position defining a delivery path which is aligned with said first part of said first path whereby cigarettes are delivered to and continue on said first part of said first path without any turning about an axis transverse to the cigarette, means for delivering at least one row of cigarettes from successive hoppers along a second part of said first path, said second part of said first path being substantially straight and parallel to said first part of said first path, said first and second parts lying on opposite sides of said first path, and second conveyor means conveying a series of receiving members along a second endless path, said second path having a first portion which is parallel with and adjacent said second part of said first path along with said at least one row of cigarettes is progressively transferred from successive hoppers to successive receiving members, and means for transferring said at least one row of cigarettes from successive receiving members along a second portion of said second path, which second portion is remote from said first path.

2. A cigarette packing machine as claimed in claim 1, wherein said individual hoppers are conveyed so that successive hoppers are substantially adjacent in said first and second parts of said first path and are separated in at least one other part of said first path.

3. A conveyor system as claimed in claim 1, wherein said first path extends generally horizontally with said first and second parts of said path lying at different levels.

4. A cigarette packing machine as claimed in claim 3, wherein each hopper is movable in a generally vertical direction while conveyed on said first path, so that it is at a higher level on said first part of said path and on a lower level along said second part of said path.

5. A cigarette packing machine as claimed in claim 4, including means for progressively raising each hopper as it passes from said second part to said first part of said first path.

6. A cigarette packing machine as claimed in claim 4, wherein said delivering means includes a pusher for expelling cigarettes in a lengthwise direction from the base of each hopper on said second part of said first path, including means for retracting the pusher subsequent to raising the hopper from said lower level.

7. A cigarette packing machine as claimed in claim 6, wherein each hopper carries its own pusher, operated by stationary cam means as the hopper is circulated around said first path.

8. A cigarette packing machine as claimed in claim 4, including cam means for raising and lowering each hopper as it is circulated around said first path.

9. A cigarette packing machine as claimed in claim 8, further including means for imposing a short term or vibratory vertical movement on the hoppers during at least part of their circulation around said first path, so as to tend to assist downward movement of the cigarettes in the hoppers.

10. A cigarette packing machine as claimed in claim 1, further including at least one driven agitator carried by each hopper, and means for driving said agitator as the hopper is circulated around said first path.

11. A cigarette packing machine as claimed in claim 10, wherein said driving means comprises cam means for imposing a recurrent reciprocating motion on said agitator.

12. A cigarette packing machine comprising a series of individual cigarette hoppers movable on an endless path, means for delivering cigarettes to successive hoppers as they pass a delivery position in a first part of said path, and means for delivering at least one row of cigarettes from successive hoppers along a second part of said path, including means for imposing vibrational reciprocal motion on the hoppers as they circulate on said path, so as to assist downward movement of cigarettes in the hoppers, wherein said vibration imposing means comprises undulating cam means for giving the hoppers recurrent vertical movement as they circulate on said path.

13. A cigarette packing machine comprising at least one hopper, means for supplying cigarettes to the hopper, means for delivering a row of cigarettes from the bottom of the hopper, said delivering means including a plunger movable from a retracted position to an extended position in order to axially remove a row from the bottom of the hopper, means for cyclically lifting and lowering the hopper relative to said plunger, said hopper being lifted when said plunger is in said extended position and lowered when said plunger is in said retracted position, and conveyor means for conveying said hopper along an endless path which passes a supply position at which said supplying means is operated and a delivery position at which said delivering means operates, wherein said lifting and lowering means includes cam means which operates on said hopper as it circulates around said path, said cam means including a plurality of undulations for promoting oscillatory movement of the hopper in addition to said cyclical lifting and lowering so as to assist general downward movement of cigarettes in the hopper.

14. A cigarette packing machine comprising a series of individual hoppers, first conveyor means for conveying said hoppers on a first endless path, means for delivering cigarettes to successive hoppers as they pass a delivery position in a first part of said path, means for delivering at least one row of cigarettes from successive hoppers along a second part of said first path, second conveyor means conveying a series of receiving members along a second endless path, said second path having a portion which is parallel with said second part of said first path along which said at least one row of cigarettes is transferred from successive hoppers to successive receiving member, a plurality of driven agitator rollers carried by each hopper and being disposed in contact with cigarettes in the hopper, and means for driving said agitator rollers as the hopper is circulated around said first path, said driving means comprising cam means for imposing a recurrent reciprocating motion on said agitator rollers and a common drive element disposed between the cam means and each of said agitator rollers.

* * * * *